US008016115B2

(12) United States Patent
Fryars

(10) Patent No.: US 8,016,115 B2
(45) Date of Patent: Sep. 13, 2011

(54) WASTE SEPARATION APPARATUS

(75) Inventor: Thomas Fryars, Clitheroe (GB)

(73) Assignee: Tek-Dry Systems Limited, Bolton (GB)

( * ) Notice: Subject to any disclaimer, the term of this patent is extended or adjusted under 35 U.S.C. 154(b) by 738 days.

(21) Appl. No.: 11/773,512

(22) Filed: Jul. 5, 2007

(65) Prior Publication Data

US 2008/0006565 A1 Jan. 10, 2008

(30) Foreign Application Priority Data

Jul. 5, 2006 (GB) ..... 0613351.6

(51) Int. Cl.
*B07B 4/00* (2006.01)
*B04B 5/12* (2006.01)

(52) U.S. Cl. ..... 209/138; 209/713; 209/147; 209/644; 209/645; 209/643; 15/345

(58) Field of Classification Search ..... 209/138, 209/713, 147, 639, 640, 643, 644, 645; 15/345
See application file for complete search history.

(56) References Cited

U.S. PATENT DOCUMENTS

| | | | | |
|---|---|---|---|---|
| 3,466,853 | A * | 9/1969 | Buick et al. | 95/269 |
| 4,268,294 | A * | 5/1981 | Laughlin et al. | 65/506 |
| 4,344,538 | A * | 8/1982 | Fujisawa et al. | 209/719 |
| 6,936,784 | B2 * | 8/2005 | Ogburn et al. | 209/576 |
| 6,957,472 | B2 * | 10/2005 | Illingworth et al. | 15/345 |

FOREIGN PATENT DOCUMENTS

| | | | |
|---|---|---|---|
| DE | 4305006 | A1 | 9/1993 |
| EP | 1072800 | A2 | 1/2001 |
| GB | 1493774 | | 11/1977 |
| GB | 1513034 | A | 6/1978 |
| GB | 2015484 | A | 9/1979 |
| JP | 2001096233 | A * | 4/2001 |
| SU | 735326 | A1 | 5/1980 |

OTHER PUBLICATIONS

GB Search Report.

* cited by examiner

*Primary Examiner* — Stefanos Karmis
*Assistant Examiner* — Luis Gonzalez
(74) *Attorney, Agent, or Firm* — Michael Best & Friedrich LLP

(57) ABSTRACT

Disclosed is a waste separation apparatus comprising a vortex initiator (10) and a vortex generator (20). The vortex generator (20) is arranged to direct the airflow from the vortex initiator (10) towards the waste to be separated. The airflow is used to separate less dense waste from more dense waste.

21 Claims, 10 Drawing Sheets

WASTE SEPARATION APPARATUS

The present invention relates to apparatus for separating waste.

It is becoming increasingly important for sustainable living to recycle waste generated domestically, commercially and industrially. Such waste, refuse and trash can be classified into different types of recyclables including metals, plastics, glass, paper and organics. Each type requires a different form of processing to allow the different types to be recycled. Therefore, there is a need to provide an apparatus to separate the different types of recyclables.

The activity of separating waste, such as plastic bags, from other waste, such as plastic bottles, is often undertaken by an individual or individuals who manually separate the waste. Such manual separation is inefficient and limited to the speed at which the individual or individuals operates. The efficiency is also affected by errors that occur in the manual separation process.

An alternative to manual separation is to use air knives. An air knife is used in a recursive recycling process to separate lighter waste from other waste using a series of laminar airflows. Laminar airflows allow the waste to be moved in the direction in which air flows. However, the flow of the air may be disrupted or distorted by heavier waste, causing the airflow to be reduced in power, or misdirected, reducing the air knives' waste separation effect.

It is an aim of preferred embodiments of the present invention to address problems associated with waste separation apparatus whether identified herein or otherwise.

According to a first aspect of the present invention, there provided a waste separation apparatus comprising: a vortex initiator for creating an airflow; and a vortex generator for forming a vortex from the airflow; wherein the vortex generator is arranged to direct the airflow from the vortex initiator towards the waste to be separated.

Suitably, the vortex generator comprises a drum for forming a vortex from the airflow directed to the waste to be separated. Suitably, the drum comprises an open end from which the airflow exits the vortex generator to separate the waste. Suitably, the drum comprises a chamber shaped to direct the airflow from the vortex initiator to form the vortex. Suitably, the chamber is cylindrical in shape. Alternatively, the chamber is cone-shaped.

Suitably, the vortex generator comprises a duct arranged to communicate the airflow from the vortex initiator to the drum. Suitably, the duct is configured to direct the airflow against an inner wall of the drum to cause a vortex to be formed. Suitably, the drum comprises a closed end, wherein the duct is arranged adjacent to the closed end to direct the airflow from the vortex initiator to form a vortex directed towards the waste to be separated. Suitably, the duct is shaped to promote vortex generation.

Suitably, the vortex initiator supplies air with a predetermined velocity to the vortex generator to generate a vortex to separate waste of up to a predetermined density from waste more dense than the predetermined density.

Suitably, a pressure difference in the airflow causes the waste of up to a predetermined density to be lifted and thrown clear of the more dense waste. In use, the vortex generator may be used to generate a vortex using air with a predetermined velocity that is communicated to it from the vortex initiator. The vortex generator causes the air to rotate towards the waste to be separated along an inner wall of the drum. Suitably, the air with a predetermined velocity is used to form a vortex with a low pressure region surrounded by a high pressure region. Suitably, the difference in pressure between the regions forms a negative pressure area that, in use, causes waste up to a predetermined density to be separated from waste having a density greater than the predetermined density. Suitably, the rotating high velocity air directs the less dense waste clear of the more dense waste.

Suitably, the waste separation apparatus further comprises a suction fan apparatus positioned to draw air from the drum to increase the pressure difference between the high pressure region and the low pressure region formed by the vortex. Suitably, the suction fan apparatus is disposed centrally relative to a closed end of the drum; wherein the closed end is opposed to the open end. Suitably, the suction fan apparatus is controlled to increase the pressure difference between the high pressure and low pressure regions to vary the predetermined density of waste to be separated.

Suitably, the waste separation apparatus comprises a conveyor to transmit waste to be separated to and from the vortex generator. Suitably, the conveyor comprises vibration means to vibrate the waste positioned on the surface of the conveyor adjacent to the drum. In use, the vibration means may be configured to vibrate waste on the conveyor for advancing the waste from a first end to a second end of the conveyor and promoting the less dense waste to be positioned above the more dense waste relative to the drum. Suitably, the conveyor comprises sidewalls arranged to, in use, prevent waste greater than the predetermined density being inadvertently divorced from the conveyor.

Suitably, the waste separation apparatus further comprises a debris director to direct the debris away from the drum. Suitably, the debris director comprises an opening arranged to correspond with the open end of the drum. Suitably, the opening is aligned centrally with respect to the drum so that the opening is arranged to be engaged with the negative pressure area formed in the drum. Suitably, the debris director comprises a duct to direct the less dense waste away from the more dense waste. Suitably, the duct is involute shaped for directing the less dense waste clear of the more dense waste. Suitably, the duct extends beyond the enclosure to direct the less dense waste out of the enclosure for further processing.

Suitably, the waste separation apparatus further comprises an enclosure. Suitably, the vortex initiator is arranged externally to the enclosure. Suitably, the vortex generator is arranged within the enclosure. Suitably, the conveyor is arranged to extend through the enclosure. Suitably, the enclosure comprises a first opening to allow waste to be transmitted into the enclosure for separating waste. Suitably, the enclosure comprises a second opening to allow separated waste to be transmitted out of the enclosure. Suitably, the enclosure comprises a separator collection area to receive the less dense waste. Suitably, the separator collection area comprises means to remove the less dense waste.

For a better understanding of the invention, and to show how embodiments of the same may be carried into effect, reference will now be made, by way of example, to the accompanying diagrammatic drawings in which.

Figure 1:
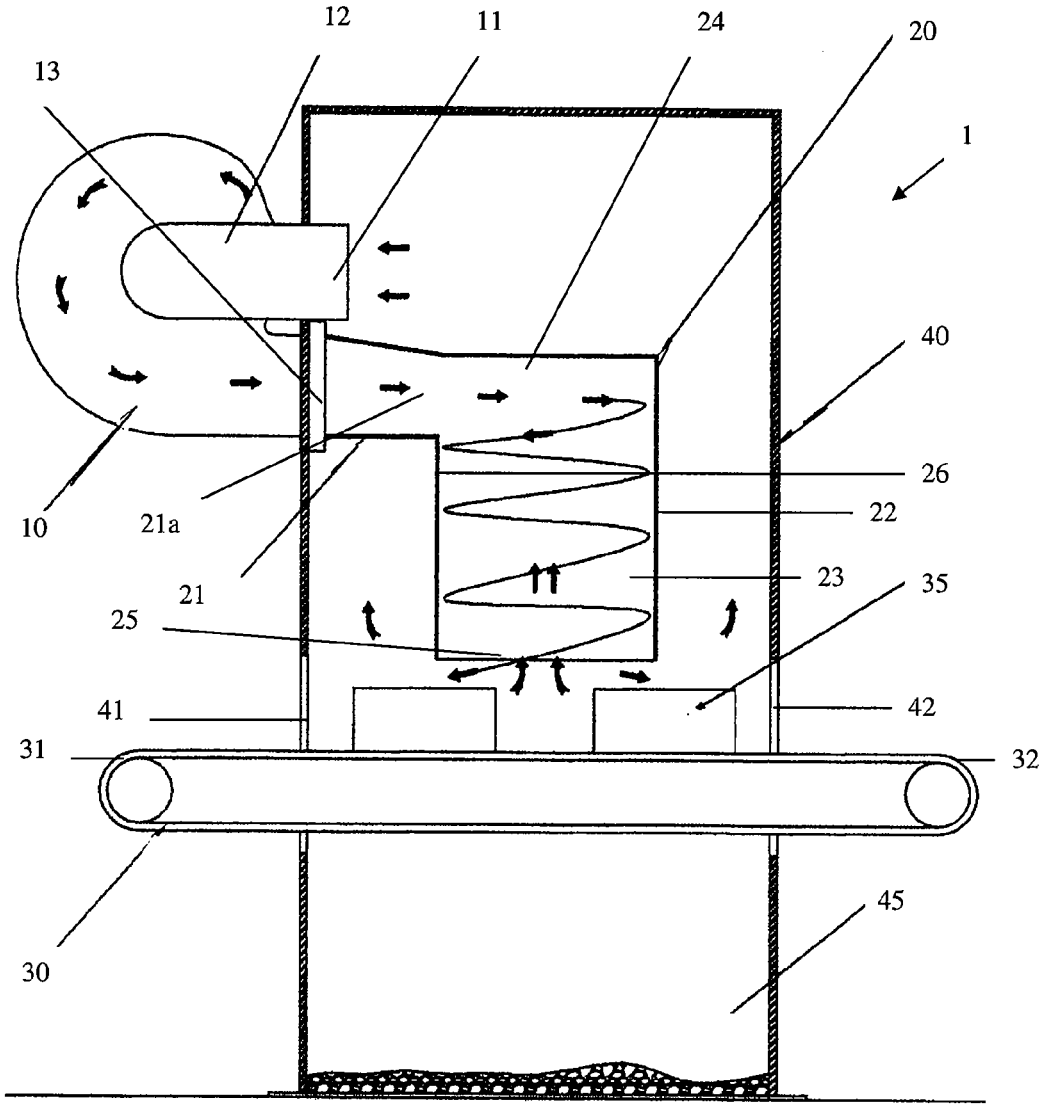
FIG. 1 shows a cross-sectional side view of a first embodiment of the present invention.
Figure 2:
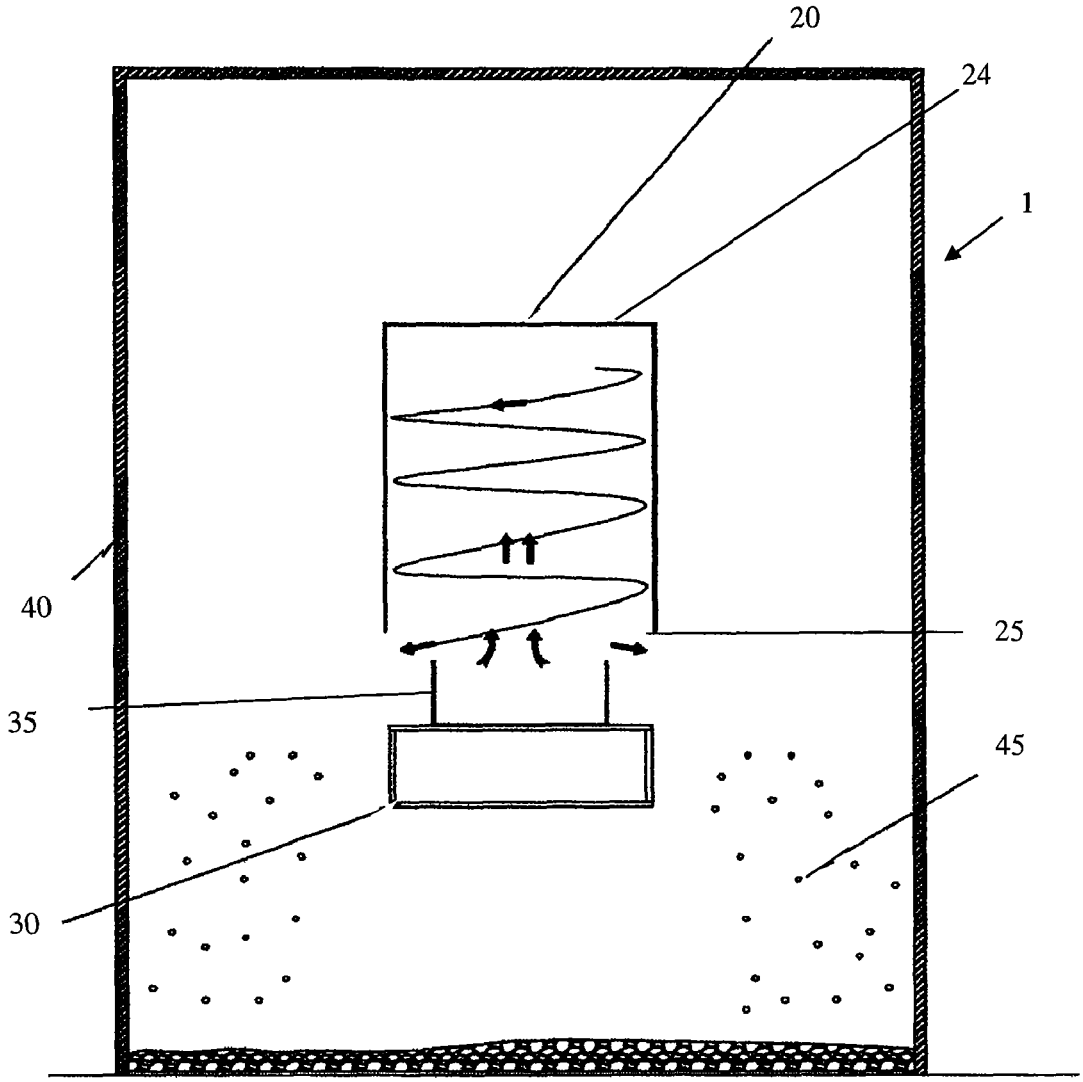
FIG. 2 shows a cross-sectional front view of a first embodiment of the present invention.

FIGS. 1 and 2 show waste separation apparatus 1 of a first embodiment of the present invention. The waste separation apparatus 1 is used to separate less dense waste from heavier waste using a vortex. The waste separation apparatus 1 separates less dense waste from more dense waste without the need for a user to manually separate the waste.

The waste separation apparatus 1 uses a vortex to dislodge less dense waste from more dense waste, lift the less dense waste clear of the more dense waste and then throw the less dense waste clear of the more dense waste. The waste separation apparatus 1 is suitable to be used in any recycling process to separate different types of waste. The waste separation apparatus 1 is also suitable for use in, for example, the food industry to remove unwanted waste debris, such as discarded or uneaten food, from containers.

The waste separation apparatus 1 comprises a vortex initiator 10, a vortex generator 20, an endless conveyor 30 and an enclosure 40. The vortex generator 20 is arranged to direct the airflow generated by the vortex initiator 10 towards the endless conveyor 30 causing less dense waste to be thrown clear of the more dense waste.

In use, the endless conveyor 30 is arranged to extend at first and second ends 31, 32 beyond the enclosure 40 and the vortex generator 20 is arranged within the enclosure 40. Waste to be separated is located at the first end of the conveyor and is transmitted into the enclosure where it is acted upon by the generated vortex. The less dense waste is thrown clear of the endless conveyor 30, and the more dense waste is advanced out of the enclosure for further processing. Less dense waste receivers are positionable beneath the endless conveyor 30 to collect the less dense waste thrown clear of the conveyor 30 to be processed itself. The waste separation apparatus 1 can be used as a stage in a process line to recycle and/or clean waste.

Less dense waste is waste that has a density of less than or equal to a predetermined density. The apparatus 1 is adaptable to vary the predetermined density of the less dense waste lifted and thrown clear by altering the distance between the generator 20 and the conveyor 30. The predetermined density can be set to, for example, separate plastic bottles from glass bottles; light plastics, such as bags and wrappers, from heavy plastics, such as food containers and bottles; plastics from metal cans; and other waste to be separated.

The vortex initiator 10 is located externally to the enclosure 40 and comprises an air inlet 11, a supply fan 12, and an air outlet 13. The provision of the vortex initiator externally to the enclosure improves its maintainability as access to, for example, the supply fan is improved.

The air inlet 11 allows air in the enclosure to be communicated to the air outlet 13 by the supply fan 12.

As an alternative, the air inlet 11 could be such as to allow air from outside the enclosure to be communicated to the air outlet 13 by the supply fan 12. The air outlet 13 allows air from the supply fan 12 to be communicated to the vortex generator to separate waste on the conveyor 30.

The supply fan 12 is configured to increase the velocity of the air flowing in from the air inlet 11 and communicate that air with increased velocity to the air outlet 13. The velocity of the air is controlled so that the strength of the vortex generated lifts waste of up to a predetermined density from the conveyor 30 and throws it clear of the conveyor 30 for further processing rather than suck it into the vortex generator 20. The initiator 10 is configured to operate to transmit air of a predetermined velocity to the generator 20. The predetermined velocity can be controlled to facilitate separating waste of up to a predetermined density from more dense waste. The higher the predetermined velocity the greater the predetermined density of waste that is lifted from the conveyor 30.

The vortex generator comprises a duct 21 and a drum 22. The duct 21 is connected to the air outlet 13 to communicate air from the vortex initiator 10 into the drum 22. The duct comprises an entry 21*a* into the drum 22 through which the airflow from the initiator 10 is directed.

The drum 22 comprises a cylindrically-shaped or cone-shaped chamber 23 with a closed end 24 and an opposed open end 25. The drum 22 is configured to direct air received from the vortex initiator 10 towards the conveyor 30.

The air introduced into the vortex generator 20 from the vortex initiator 10 exits the generator 20 at the open end 25. The generator 20 is positioned to communicate air from the closed end 24 to the open end 25 to the conveyor 30 to disturb and dislodge the less dense waste. In the preferred embodiment, the duct 21 is positioned to introduce air into the closed end 23 and the open end 24 is positioned above the conveyor 30.

The shape of the drum 22 causes the air flowing within it to form the vortex. The shape of the drum 22 causes the air from the initiator 10 to rotate about the inner wall 26 of the drum 22. The rotation causes a vortex to be formed, i.e. high velocity air communicated to the drum 22 from the initiator 10 is forced to rotate about the inner wall 26 causing the formation of a high pressure region relative to the inner wall 26 and a lower pressure region relative to the centre 26 of the drum 22 about which the high velocity air and high pressure region rotate. The effect of the high pressure region and low pressure region is to generate an area of negative pressure in the drum 22.

In use, the waste entering the enclosure 40 is increasingly moved along the conveyor 30 so that the waste is first engaged with the high velocity air, which disturbs the waste. The less dense waste is then lifted clear from the conveyor due to the effect of the negative pressure area generated towards the centre of the vortex. The less dense waste is then thrown clear of the conveyor 30 and deposited at the base of the enclosure 40. The distance between the conveyor 30 and the open end 25 can be varied to alter the predetermined density of the less dense waste that is lifted and thrown clear of the conveyor 30.

The enclosure 40 comprises a first and second opening 41, 42 through which the first and second ends 31, 32 of the conveyor 30 extend. Waste is introduced into the enclosure 40 through the first opening 41 in a plurality of containers 35. Within the enclosure the less dense waste is separated from each of the containers 35 leaving the more dense waste in each of the containers 35. The containers exit the enclosure 40 through the second opening 42.

The less dense waste is thrown clear of the conveyor 30 and other containers on the conveyor 30 by the vortex. The less dense waste is collected in a separator collection area 45 at the base of the enclosure 40. The efficiency, in terms of waste throughput, is limited by the separation efficiency between the containers 35.

The effect of the vortex is to lift and throw the less dense waste clear of the conveyor. The further the less dense waste moves from the conveyor the less the vortex has an effect on the less dense waste causing it to be deposited in the separator collection area 45. The deposition of the less dense waste in the collection area 45 means that the need for additional air filtration equipment is dispensed with. The separator collection area 45 can comprise an additional endless conveyor, auger, blow line and/or bins to facilitate removal of the less dense waste from the enclosure 40.

The endless conveyor 30 further comprises side walls fitted to the conveyor to prevent the waste from being inadvertently removed from the conveyor 30 by the vortex. In the instance where the waste is not deposited directly onto the conveyor 30 but is contained within a container or series of containers 35, the conveyor 30 will comprise additionally of side guides to releasably fix the container 35 to the conveyor 30. The endless conveyor can further comprise top guides to releasably fix a container 35 to the conveyor 30. The guides are provided to prevent the vortex affecting the alignment of the container on the conveyor 30.

The waste separation apparatus 1 is fabricated from stainless steel, protected mild steel, aluminium or other suitable materials. The apparatus 1 is fabricated from stainless steel for use in the food industry. The apparatus is fabricated by casting, extrusion, pressing or other suitable fabrication processes.

Figure 3:
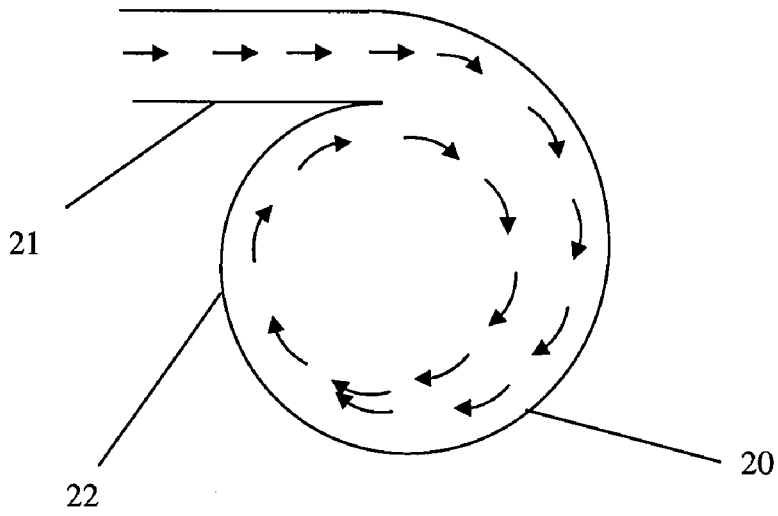
FIG. 3 show a plan view of a vortex generator of a first embodiment of the present invention.

FIG. 3 shows how the duct 21 is positioned to promote vortex generation. The duct is arranged to extend adjacent the closed end 24 to the air outlet 13. The duct 21 is positioned on the drum 22 to direct the airflow from the vortex initiator 10 against the inner wall 26 to promote air rotation within the drum causing a vortex to be generated. The duct 21 is positioned to extend substantially tangentially from the drum 22.

In the preferred embodiment, the duct 21 extends tangentially from the drum adjacent to the closed end 24 in an elongated arc with respect to the circumference of the inner wall 26. The elongated arc causes the airflow to be directed against the inner wall 26, and, as the chamber 23 is cylindrical or cone shaped, the airflow is directed to rotate about the inner wall causing a vortex to be formed.

Figure 4:
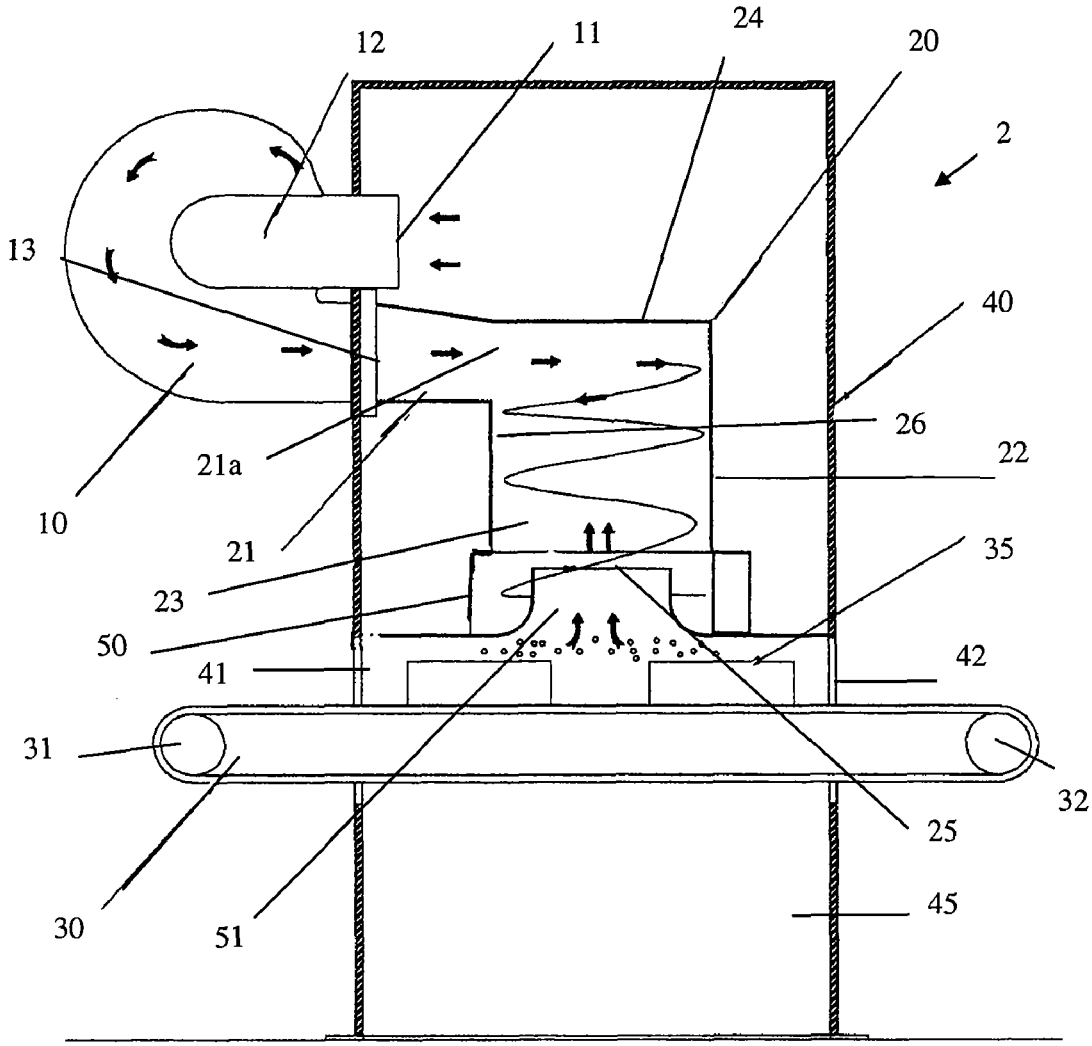
FIG. 4 shows a cross-sectional side view of a second embodiment of the present invention.
Figure 5:
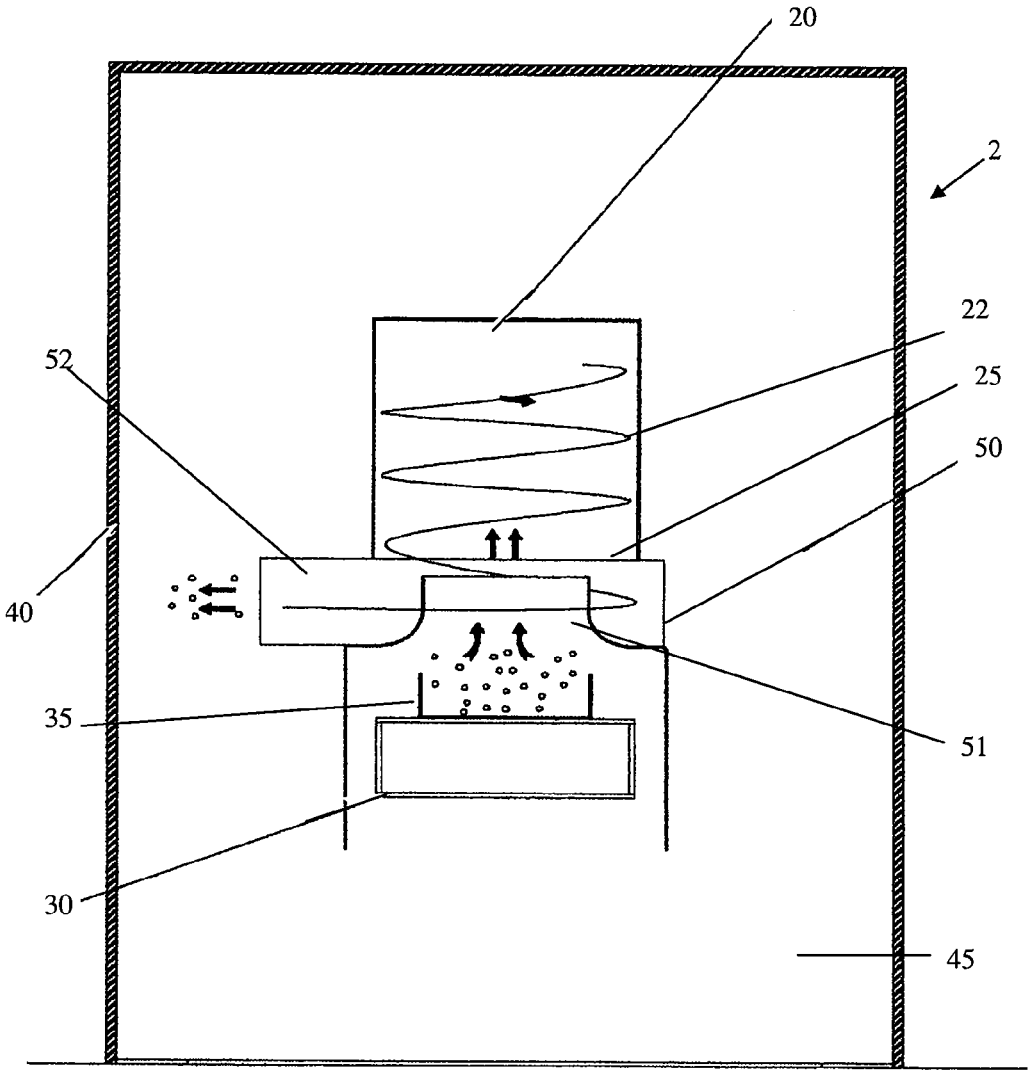
FIG. 5 shows a cross-sectional front view of a second embodiment of the present invention.

FIGS. 4 and 5 show a waste separation apparatus 2 of a second embodiment of the present invention. The waste separation apparatus 2 comprises the features of the first embodiment and a debris director 50. The debris director 50 is configured to direct debris or less dense waste lifted from the endless conveyor 30 to the separator collection area 45.

The debris director 50 has an opening 51 into the open end 25 of the drum 22 arranged to correspond with the negative pressure area and a duct 52 to transmit the debris from the debris director 50 to the collection area 45. The director 50 causes debris or less dense waste to be lifted from the conveyor through the opening 51 and into the duct 52. The debris director is arranged to substantially prevent the high pressure region of the vortex from affecting the waste on the conveyor 30. This arrangement ensures that unwanted waste separation does not occur through the vortex picking up waste comprising the incorrect density.

Although the duct 52 is described as being arranged within the enclosure 40, the duct 52 and enclosure 40 can easily be adapted to allow the duct 52 to extend beyond the enclosure 40 to deposit the separated waste externally for further processing.

Figure 6:
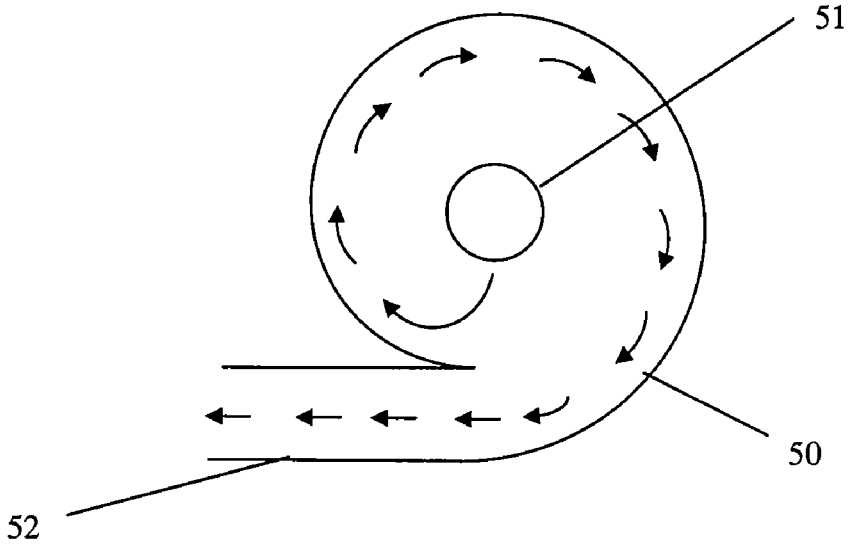
FIG. 6 shows a plan view of a debris director of a second embodiment of the present.

FIG. 6 shows how the duct 52 is positioned to direct the debris or less dense waste. The duct 52 is arranged to extend tangentially from an outer circumference of the debris director 50. In the preferred embodiment, the duct 52 extends tangentially in an elongated arc with respect to the outer circumference of the debris director 52. The elongated arc causes the airflow of the high pressure region acting upon the debris director to direct the less dense waste entering the debris director into the duct 52. The directed airflow causes the debris director 50 to act like a suction fan remote or disconnected from the supply fan 12. The debris director 50 acts like a suction fan without the need to supply an additional fan or blower to direct the separated waste.

Figure 7:
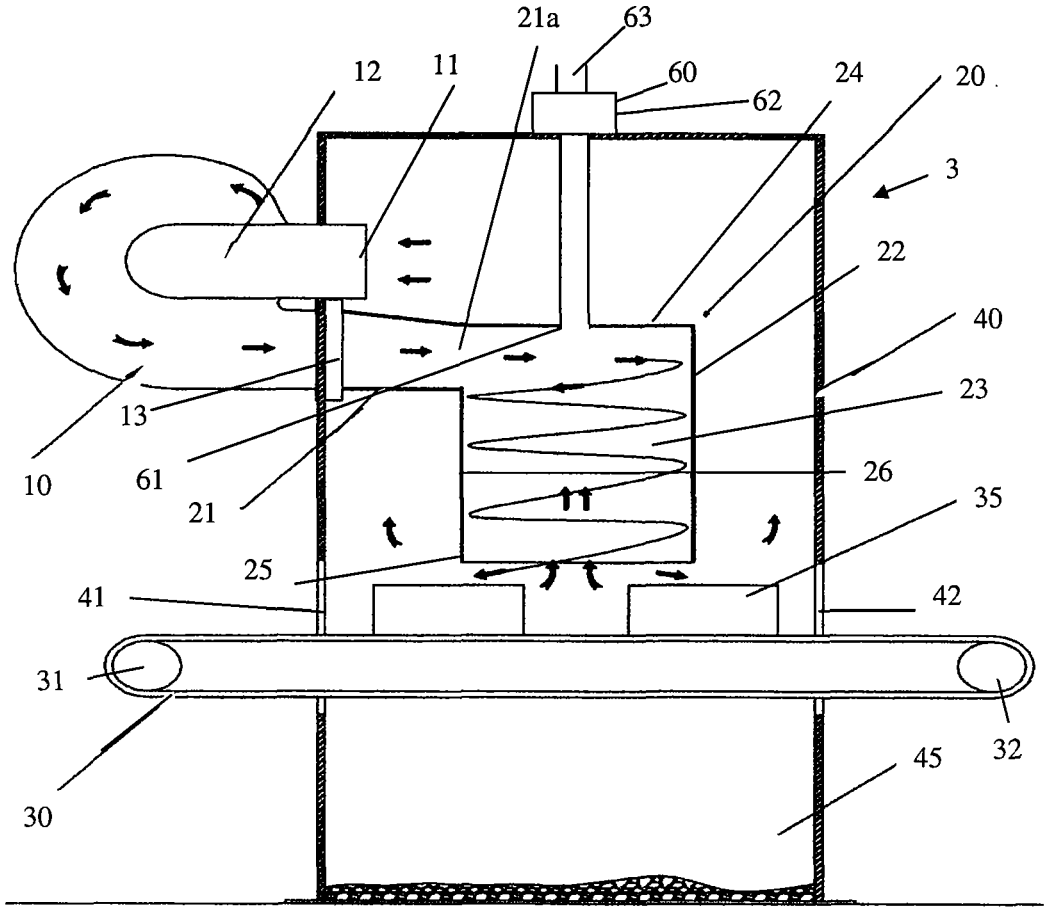
FIG. 7 shows a cross-sectional side view of a third embodiment of the present invention.
Figure 8:
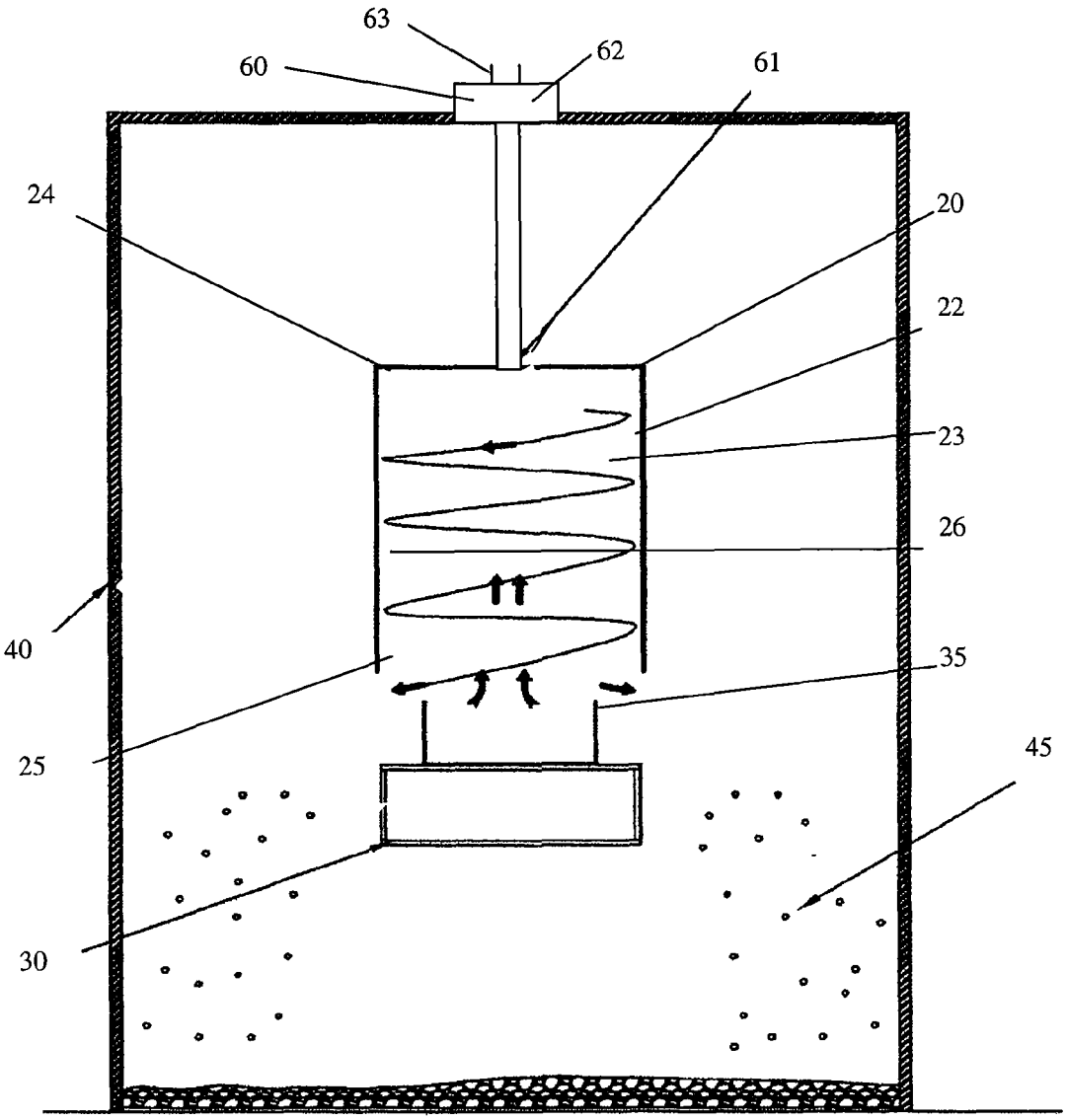
FIG. 8 shows a cross-sectional front view of a third embodiment of the present invention.

FIGS. 7 and 8 show a waste separation apparatus 3 of a third embodiment of the present invention. The waste separation apparatus 3 comprises the features of the first embodiment plus suction fan apparatus 60 centrally located on the closed end 24 of the drum 22. The suction fan apparatus 60 comprises an air inlet 61, a suction fan 62 and an air outlet 63. The suction fan apparatus 60 is controllable to suck air from the chamber of the drum 22 to control the amount of negative pressure generated between the high pressure region and the low pressure region. The suction fan apparatus 60 is controlled to produce a predetermined amount of suction to vary the predetermined density of less dense waste to be removed from the conveyor 30.

The air inlet 61 is located centrally on the closed end 24 of the drum 22 to correspond with the centre of the low pressure region of the vortex formed in the drum 22. The air inlet 61 is arranged to communicate air from the drum 22 to the suction fan 62. The suction fan 62 sucks air from the drum and expels that air through the air outlet 62. In the preferred embodiment, the suction fan 62 is positioned externally to the enclosure for ease of maintenance.

The speed of the suction fan 62 is controlled to control the density of waste separated from the conveyor 30. The speed of the suction fan determines the amount of air extracted from the drum. The air inlet 61 is located centrally above the drum to correspond with the low pressure region formed by the vortex. The air sucked from the drum 22 through the air inlet 61 further reduces the pressure in the low pressure region. The reduction in pressure leads to the difference in pressure between the high pressure region and low pressure region being increased, resulting in an increase in the negative pressure between these regions.

Figure 9:
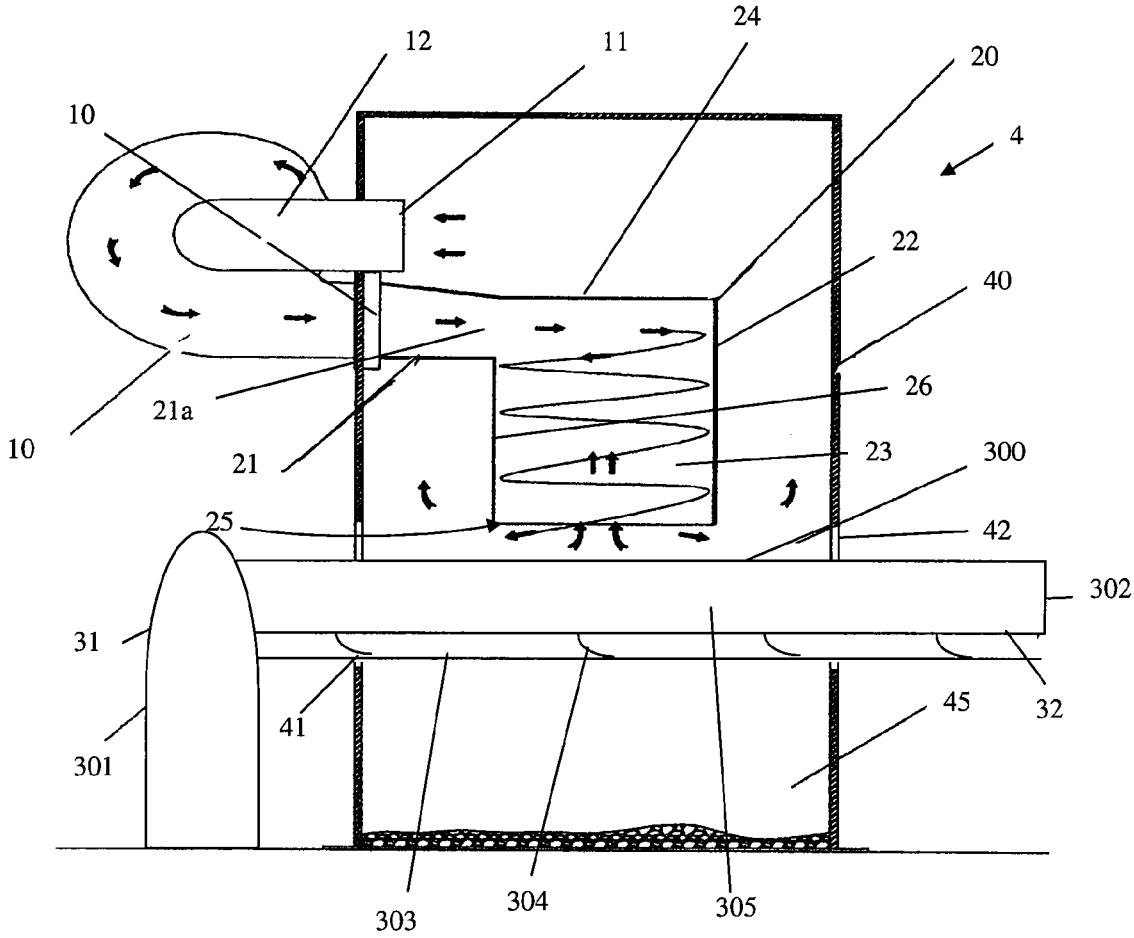
FIG. 9 shows a cross-sectional side view of a fourth embodiment of the present invention.
Figure 10:
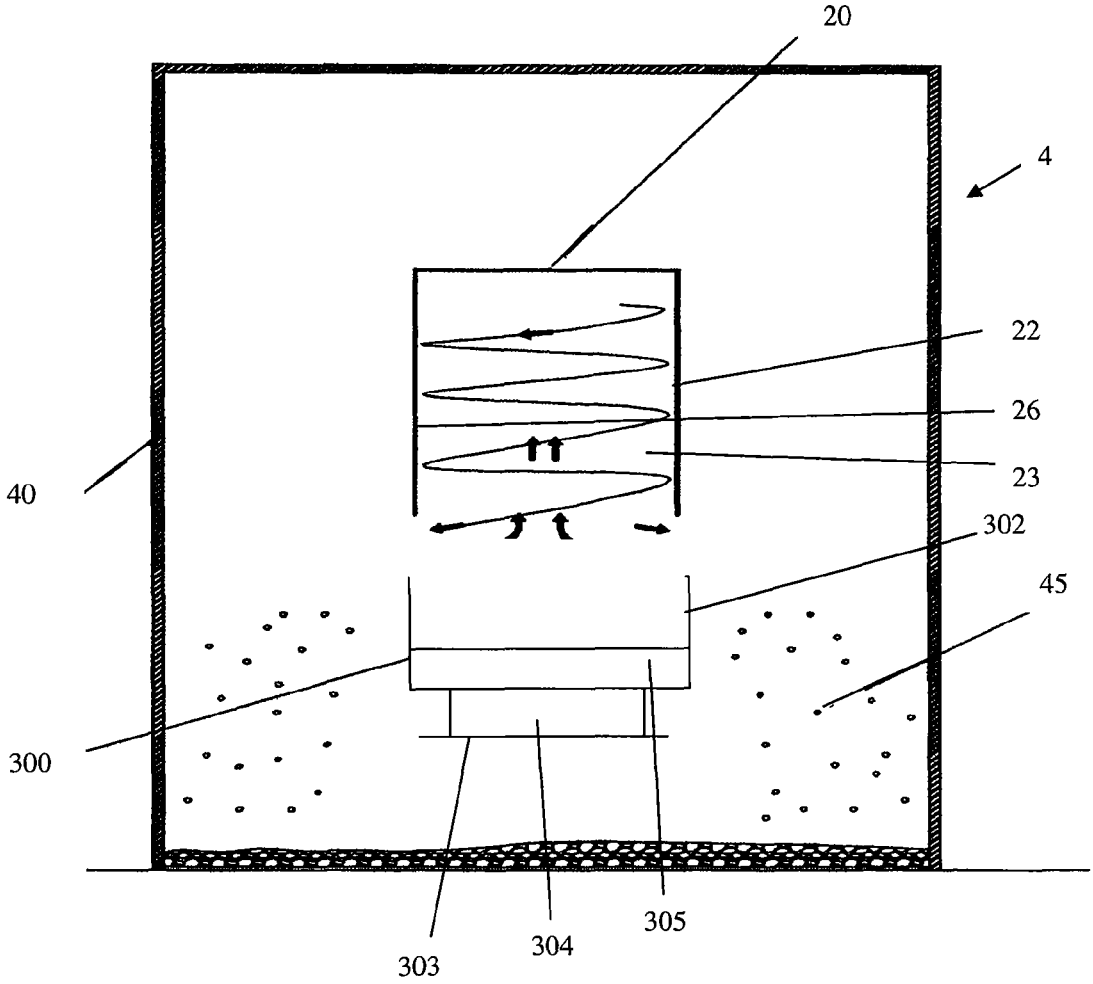
FIG. 10 shows a cross-sectional front view of a fourth embodiment of the present invention.

FIGS. 9 and 10 show a waste separation apparatus 4 of a fourth embodiment of the present invention. The waste separation apparatus 4 comprises the features of the first embodiment and a vibrating conveyor 300. The vibrating conveyor 300 is operable as described for the endless conveyor 30, to input waste into, and output waste out from, the enclosure 40. The vibrating conveyor 300 comprises a vibration means 301 to vibrate the waste on the vibrating conveyor 300. The effect of vibrating the conveyor 300 is to advance the waste to be separated from the first end 31 to the second end 32 and promote separation of the less dense waste from the more dense waste. The promotion effect is achieved as vibrating waste in this way causes the less dense waste to be promoted to the top of the container 35 relative to the drum 22 to facilitate easier separation of the less dense from waste greater than that density.

The vibration means 301 comprises a vibration motor configured to vibrate a conveyor section 305 of the vibrating conveyor 300. The vibration means 301 causes the conveyor 300 to vibrate in both horizontal and vertical planes relative to the first and second ends 31, 32 of the conveyor. The vibration causes the advancement and promotion of waste as described above. The vibration means 301 further comprises a plate 303 connected to the conveyor section 305 by at least one arm 304. The arms and plate are provided to resiliently support the conveyor section 300.

FIG. 3 shows four arms 304, but any number of arms may be used to resiliently support the conveyor section 305.

The conveyor section 305 further comprises sidewalls 302 to prevent the waste from being inadvertently removed from the vibrating conveyor 300 by the vortex. The sidewalls 302 are provided to prevent waste with a density greater than the predetermined density from being removed from the vibrating conveyor 302. The conveyor section 305 is shaped to be a trough with a U-shaped cross section.

Although the features of the second, third and fourth embodiments have been described as functioning in isolation of each other, the person skilled in the art would appreciate that the features of these embodiment may be easily combined. For example, to boost targeted separation, the vibrating conveyor 300 can be easily combined with the vortex suction fan apparatus 60. Such a combination provides an apparatus where the less dense waste is more easily separated from the more dense waste, and the strength of the vortex can be accurately controlled to ensure that only waste of the predetermined density is thrown clear of the conveyor 300.

The waste separation apparatus 1, 2, 3, 4 according to embodiments of the present invention is easily maintainable and efficient. The apparatus 1, 2, 3, 4 comprise a small number of moving parts, which are easily accessible for maintenance or repair. The efficiency of the apparatus is only limited by the amount waste that can be provided on the conveyor 30, 300.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A waste separation apparatus comprising:

a vortex initiator for creating an airflow; and a vortex generator for forming a vortex from the airflow and for directing the airflow from the vortex initiator towards a plurality of waste items to be separated, so that a pressure difference in the airflow causes waste items of up to a predetermined density to be lifted and thrown clear of waste items of greater than the predetermined density, and so that none of the waste items are sucked into the vortex generator (20), wherein the vortex generator (20) comprises a drum (22) comprising an open end (25) for forming a vortex from the airflow directed to the waste to be separated, and wherein the drum comprises a cylindrically-shaped chamber to direct the airflow from the vortex initiator to form the vortex.

2. The waste separation apparatus according to claim 1, wherein the vortex generator comprises a duct arranged to communicate the airflow from the vortex initiator to the drum.

3. The waste separation apparatus according to claim 2, wherein the duct is configured to direct the airflow against an inner wall of the drum to cause a vortex to be formed.

4. The waste separation apparatus according to claim 3, wherein the drum comprises a closed end, wherein the duct is arranged adjacent to the closed end to direct the airflow from the vortex initiator to form a vortex directed towards the waste to be separated.

5. The waste separation apparatus according to claim 1, wherein the vortex initiator (10) supplies air with a predetermined velocity to the vortex generator (20) to generate a vortex to separate waste of up to a predetermined density from waste more dense than the predetermined density.

6. The waste separation apparatus according to claim 5, wherein the air with a predetermined velocity is used to form a vortex with a low pressure region surrounded by a high pressure region, the high pressure region formed adjacent to an inner wall (26) of the drum (22); and wherein the difference in pressure between the regions forms a negative pressure area that, in use, causes waste up to a predetermined density to be separated from waste having a density greater than the predetermined density.

7. The waste separation apparatus according to claim 1, wherein the waste separation apparatus comprises a conveyor (30, 300) to transmit waste to be separated to and from the vortex generator (20).

8. The waste separation apparatus according to claim 7, wherein the conveyor (30, 300) comprises vibration means (301) to vibrate the waste positioned on the surface of the conveyor (30, 300) for advancing the waste from a first end (31) to a second end (32) of the conveyor and promoting the less dense waste to be positioned above the more dense waste relative to the drum (22).

9. The waste separation apparatus according to claim 1, wherein the waste separation apparatus further comprises a debris director (50) to direct the debris away from the vortex generator (20).

10. The waste separation apparatus according to claim 9, wherein the debris director (50) comprises an opening (51) arranged to correspond with the open end (25) of the drum (22); wherein the opening (51) is aligned centrally with respect to the drum (22) so that opening (51) is arranged to be engaged with the negative pressure area formed in the drum (22).

11. The waste separation apparatus according to claim 9, wherein the debris director (50) comprises a duct (52) to direct the less dense waste away from the more dense waste.

12. The waste separation apparatus according to claim 11, wherein the enclosure (40) comprises a separator collection area (45) to receive the less dense waste.

13. The waste separation apparatus according to claim 12, wherein the separator collection area (45) comprises means to remove the less dense waste.

14. The waste separation apparatus according to claim 1, wherein the waste separation apparatus further comprises an enclosure (40).

15. The waste separation apparatus according to claim 14, wherein the vortex initiator (10) is arranged externally from the enclosure (40) and the vortex generator (20) is arranged within the enclosure (40).

16. A waste separation apparatus comprising: a vortex initiator for creating an airflow; and a vortex generator for forming a vortex from the airflow and for directing the airflow from the vortex initiator towards waste items to be separated, wherein the vortex generator (20) comprises a drum (22) comprising an open end (25) for forming a vortex from the airflow directed to the waste to be separated, wherein the waste separation apparatus further comprises a suction fan for drawing air from the drum (22) to increase the pressure difference between the high pressure region and the low pressure region formed by the vortex, and wherein the drum comprises a cylindrically-shaped chamber to direct the airflow from the vortex initiator to form the vortex.

17. The waste separation apparatus according to claim 16, wherein the suction fan is disposed centrally relative to a closed end (24) of the drum (22).

18. The waste separation apparatus according to claim 16, wherein the suction fan is controlled to increase the pressure difference between the high density and low density regions to vary the predetermined density of waste to be separated.

19. The waste separation apparatus according to claim 16, wherein a pressure difference in the airflow causes the waste of up to a predetermined density to be lifted and thrown clear of the more dense waste, and wherein the waste is not sucked into the vortex generator (20).

20. A waste separation apparatus comprising: a vortex initiator for creating an airflow; and a vortex generator for forming a vortex from the airflow; wherein the vortex generator is arranged to direct the airflow from the vortex initiator towards the waste to be separated, wherein the waste separation apparatus further comprises an enclosure (40, and a conveyor (30) to transmit waste to be separated to and from the vortex generator (20, and wherein the conveyor (30) is arranged to extend through first and second openings of the enclosure (40) to allow waste to be transmitted into and out of the enclosure (40) for separating less dense waste from more dense waste.

21. The waste separation apparatus according to claim 20, wherein a pressure difference in the airflow causes the waste of up to a predetermined density to be lifted and thrown clear of the more dense waste and clear of the conveyor, and wherein the waste is not sucked into the vortex generator (20).

* * * * *